United States Patent [19]

Audeh

[11] Patent Number: 4,552,725

[45] Date of Patent: Nov. 12, 1985

[54] APPARATUS FOR CO-PROCESSING OF OIL AND COAL

[75] Inventor: Costandi A. Audeh, Princeton, N.J.

[73] Assignee: Mobil Oil Corporation, New York, N.Y.

[21] Appl. No.: 464,165

[22] Filed: Feb. 7, 1983

Related U.S. Application Data

[63] Continuation-in-part of Ser. No. 271,054, Jun. 5, 1981, Pat. No. 4,390,409.

[51] Int. Cl.[4] ..... B01J 8/18

[52] U.S. Cl. ..... 422/140; 196/14.52; 208/8 LE; 422/144; 422/147; 422/193; 422/232

[58] Field of Search ..... 422/140, 144, 147, 189, 422/193, 232, 233; 208/8 LE, 251 R; 196/14.52; 202/84

[56] References Cited

U.S. PATENT DOCUMENTS

| | | | |
|---|---|---|---|
| 2,631,928 | 3/1953 | Howe et al. | 422/193 |
| 2,963,421 | 12/1960 | Luckenbach | 196/134 X |
| 3,705,092 | 12/1972 | Gatsis | 208/8 LE |
| 3,785,782 | 1/1974 | Cartwell | 422/147 X |
| 3,870,621 | 3/1975 | Arnold et al. | 208/8 LE |
| 3,966,585 | 6/1976 | Gray et al. | 208/8 LE |
| 4,040,941 | 8/1977 | Yamada et al. | 208/8 LE |
| 4,054,504 | 10/1977 | Chervenak et al. | 208/10 |
| 4,097,243 | 6/1978 | Bartholic | 422/140 |
| 4,108,758 | 8/1978 | Schoennagel et al. | 208/8 LE |
| 4,111,786 | 9/1978 | Sugimura et al. | 208/8 LE |
| 4,159,237 | 6/1979 | Schmid | 208/8 LE X |
| 4,309,274 | 1/1982 | Bartholic | 208/251 R X |
| 4,310,489 | 1/1982 | Fahrig et al. | 422/147 X |
| 4,311,579 | 1/1982 | Bartholic | 208/251 R X |
| 4,313,910 | 2/1982 | Dries et al. | 422/147 |
| 4,330,388 | 3/1982 | Anderson et al. | 208/8 LE |
| 4,390,409 | 6/1983 | Audeh | 208/8 LE |

*Primary Examiner*—Barry S. Richman
*Assistant Examiner*—Brion P. Heaney
*Attorney, Agent, or Firm*—Alexander J. McKillop; Michael G. Gilman; Dennis P. Santini

[57] ABSTRACT

Apparatus adapted for converting coal and heavy oil to volatile hydrocarbons comprising a thermal cracking reactor having a thermal cracking zone enclosed in an interior tubular riser within a vertical shell, lower inlet means for receiving hot coal and heavy oil and upper outlet means for removing a first cracked hydrocarbon volatilized portion and a non-volatile portion, said outlet means including a plurality of horizontally radial conduits for distributing reaction products from the thermal cracking zone outwardly. An enclosed steam stripping zone is operatively connected to receive the non-volatile portion from the thermal cracking zone having means for contacting superheated steam with said non-volatile portion at higher temperature for removing a second volatilized hydrocarbon portion from the non-volatile portion.

The apparatus includes a combustor having an upper heating chamber and a lower combustion chamber. The heating chamber and combustion chamber are separated by a combustor riser which also supports a bed of feed coal and includes an opening for the passage of combustion gases whereby the feed coal supported on the combustor riser is indirectly heated. The preheated feed coal is supplied to the bottom of the riser reactor and the non-volatile portion of the reaction products is supplied from the stripping chamber to the combustion chamber.

The stripping zone may be disposed in a cylindrical stripping chamber located in an annular portion of the vertical shell surrounding the interior tubular riser.

In another embodiment, the thermal cracking zone and stripping zone are separately housed pressure vessels.

9 Claims, 2 Drawing Figures

APPARATUS FOR CO-PROCESSING OF OIL AND COAL

This is a continuation-in-part of copending application Ser. No. 271,054, filed June 5, 1981, now U.S. Pat. No. 4,390,409.

BACKGROUND OF THE INVENTION

1. Field of the Invention

This invention relates to a system for co-processing of residual oil and coal. More particularly, it relates to equipment and processes for the volatilization and solubilization of coal and the demetallization of residual oil. This invention especially relates to the processing of residual oil and coal to provide metals-free distillates and a metals-containing solid fuel.

2. Description of the Prior Art

Petroleum has been utilized heretofore as a major source of energy, particularly because of its relatively low cost and its availability in liquid form which permitted ease of transportation and ultimate use. This relatively clean burning energy source presents a minimum of disposal problems and thus has found wide-spread use throughout the world. Natural gas is a fuel which has also been utilized as a particularly useful form of energy but its gaseous form has limited its transportability and hence it has not found the world-wide use that petroleum has. Recent economic and political development have led to increasingly high purchase prices for both of these products. In addition, the high cost of energy from petroleum and natural gas as well as their potentially limited availability has led to investigation of alternate sources of energy such as oil shale and tar sands. There has recently been an increased interest in coal as a major energy source. Reserves of coal are far greater than the known reserves of all other mineral fuels (petroleum, natural gas, oil shale and tar sands) combined. Since coal is a solid fuel and when burned in this form requires disposition of residual ash, its use as a major energy source is not as desirable as either petroleum or natural gas. However, processes have been and are being developed to convert coal into both liquified and gaseous fuels which will increase its desirability as a useful energy source. Although these conversion processes have not proven economical heretofore, the increasing cost of conventional energy sources make these conversion techniques more and more attractive.

Coal liquefaction and gasification processes developed heretofore utilize a wide variety of techniques including thermal and catalytic conversion, non-hydrogenative and hydrogenative conversion and various combinations thereof. Patent art in this area includes the following:

U.S. Pat. No. 3,870,621 of Arnold, et al discloses contacting a liquid phase of a petroleum residual oil with finely divided coal in a fixed or moving bed at a temperature in the range of 700°–900° F. to produce cracked products from the oil and hydrocarbons from the coal which are fractionated to produce a heavy recycle stream and lighter products. The solid char recovered as a product from the contacting zone can find use as a high quality solid fuel.

U.S. Pat. No. 4,108,758 of Schoennagel, et al discloses a process for obtaining liquid fuels from coal which involves the solubilizing of coal in a fluid catalytic cracked residual oil to form a solvated coal solution phase and an ash solid phase. The two phase admixture is fluid catalytically cracked in the presence of a zeolite cracking catalyst to produce a hydrocarbon phase and a catalyst-ash solids phase. The catalyst-ash solids phase is treated in a catalyst regeneration zone whereby entrained ash solids are removed from the flue gas effluent from the catalyst regenerator.

Although most of prior art coal conversion processes employ hydrogen, Arnold et al and Schoennagel et al do not employ added hydrogen in the conversion step. In Arnold, et al the heavy feed is essentially catalytically cracked, utilizing solid sub-bituminous or lower rank coal particles as the catalyst under temperature conditions of 700°–900° F., a pressure between 10 and 100 psig and a space velocity of 0.1 to 3.0 lbs. of oil per hour per pound of coal. The liquid product is fractionated to a light fraction recovered as the product with the higher boiling fraction recycled to the contacting zone. A solid char is withdrawn from the bed of coal and is utilized as solid fuel. In Schoennagel et al a mixture of residual oil and coal is admixed with gas oil and introduced into a conventional catalytic cracking reactor to produce the conventional liquid products obtained in catalytic cracking. The ash from the coal is recovered in the gaseous effluent from the regenerator vessel.

It is an object of this invention to provide a system for converting mixtures of petroleum residua and coal to useful products.

It is another object of this invention to provide apparatus for the volatilization and solubilization of coal and the demetallization of residual oil from residual oils co-processed with coal.

It is a further object of this invention to convert petroleum residual oil and coal to products including metals-free distillate and metals-containing solid fuel.

SUMMARY OF THE INVENTION

In accordance with the present invention, it has been found that coal and petroleum residual oil can be co-processed under system conditions which are effective to provide metals-free distillates and metals-containing solid fuel. More particularly, it has been found that a mixture of coal and petroleum residuum can be subjected to temperatures to effect volatilization and solubilization of the coal and demetallization of the residual oil.

A preferred embodiment of this invention provides apparatus for converting coal and heavy oil to volatile hydrocarbons comprising (a) a closed vertical, thermal cracking zone reactor having lower inlet means for receiving hot coal and heavy oil and upper outlet means for removing a first cracked hydrocarbon volatilized portion and a non-volatile portion;

(b) an enclosed steam stripping zone operatively connected to receive the non-volatile portion from the thermal cracking zone having means for contacting superheated steam with said non-volatile portion at higher temperature, thereby removing a second volatilized hydrocarbon portion from the non-volatile portion;

(c) means for fractionating said first and second volatilized portions to obtain hydrocarbon products;

(d) means for transporting the stripped non-volatile portion from the stripper zone to a combustion zone to produce hot combustion gas;

(e) means for heating water with the hot combustion gas to produce superheated steam;

(f) conduit means for transporting superheated steam to the stripping zone;

(g) coal heating means for heating feed coal indirectly with the hot combustion gas; and (h) mixing means operatively connected with the cracking zone for receiving and mixing hot heavy oil and hot coal.

The thermal cracking zone reactor may be enclosed in an interior tubular riser within a vertical shell containing the stripping zone outside the cracking zone. Advantageously, the apparatus of the cracking zone outlet means includes a plurality of horizontally radial conduits for distributing reaction products from the thermal cracking zone outwardly, with radial conduits terminating above the outer steam stripping zone whereby non-volatile portions of said reaction product flow by gravity through the stripping zone and the first volatilized portion is separated from the non-volatile portion above the stripping zone.

In one embodiment, the steam stripping zone is disposed in a cylindrical stripping chamber located in an annular portion of the vertical shell surrounding the interior tubular riser, said annular portion supporting a downwardly staggered array of stripping baffles and lower steam inlet to provide at least a portion of said superheated steam at the bottom of the stripping zone for countercurrent stripping.

Embodiments involving the combustion zone concern preheating the coal, the residual oil or mixtures thereof by means of indirect heat exchange in the combustion zone.

THE DRAWINGS

FIG. 1 is a schematic flowplan illustrating an embodiment of the process of the invention; and FIG. 2 is a schematic system flow diagram showing an alternative embodiment.

DESCRIPTION OF THE PREFERRED EMBODIMENTS

Figure 1:
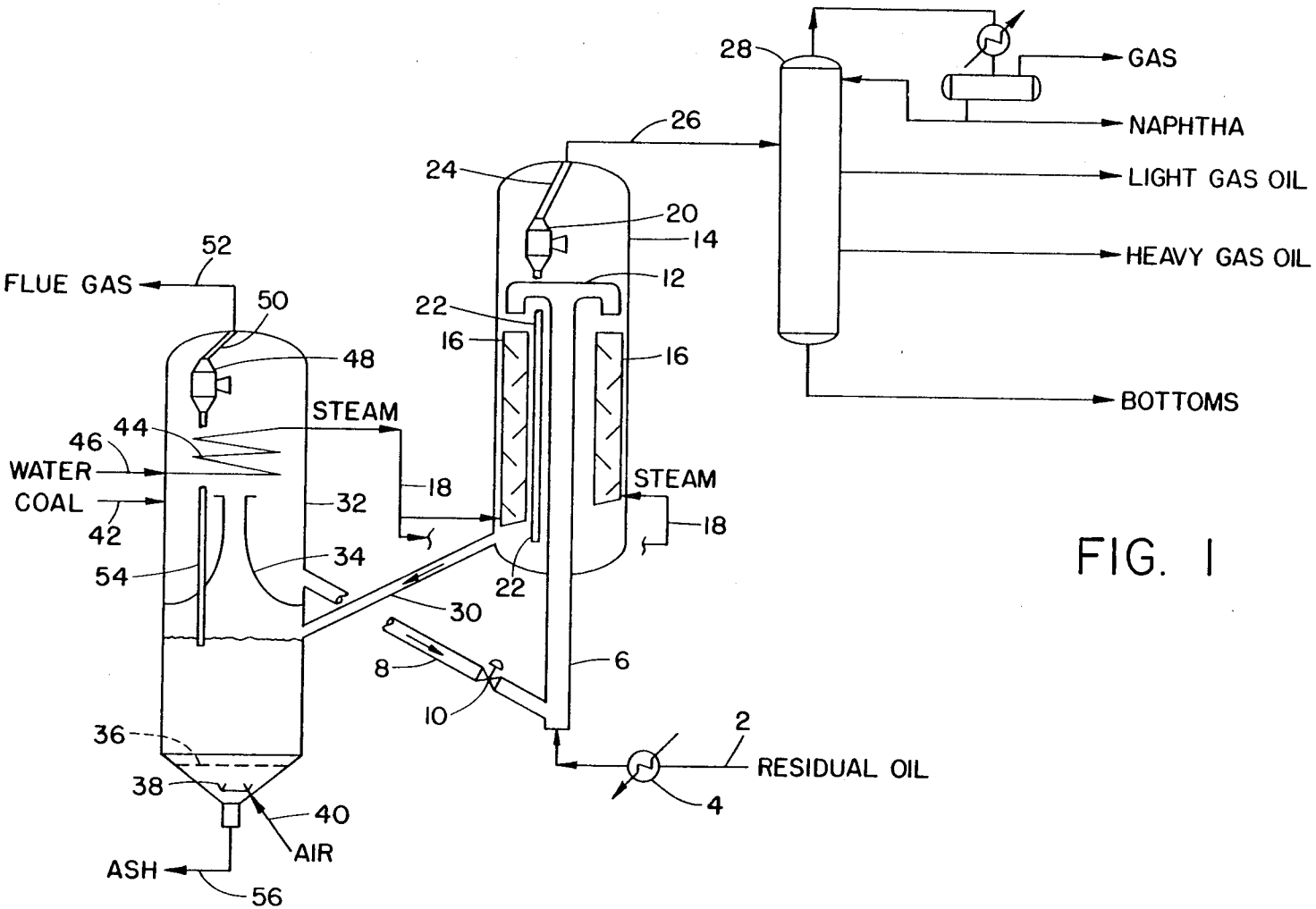

The present invention relates to a system for the volatilization and solubilization of coal and the demetallization of residual oil. Briefly, this system may be described as means for subjecting a mixture of coal and residual oil to elevated temperatures to produce a first volatile fraction and a first non-volatile residue means for contacting the first residue with high temperature steam to provide an additional volatile fraction and another non-volatile residue, fractionating means for distilling both volatile fractions to produce the fractions normally obtained from the fractionator of a catalytic cracking unit and combustion means for burning the remaining non-volatile residue to provide heat for preheating the coal and the residual oil and for preparing superheated steam.

Thus, this system involves a number of individual steps or operations. In one embodiment the initial operation involves combining coal at an elevated temperature of about 700° F. with a metals containing residual oil at a temperature below its incipient coking temperature, i.e. at about 930° F., in a weight ratio which will provide an intermediate temperature effective to cause two concomitant reactions to take place. In the first, the coal is volatilized and solubilized and in the second the residual oil is demetallized. In addition, the reaction conditions are such that substantially no coking of the resid takes place. Two products are thus obtained, (1) a volatile fraction produced as a result of the thermal cracking of the resid and the volatilization/solubilization of the coal and (2) a non-volatile residue from both the coal and the residue oil. To obtain more volatile hydrocarbons this non-volatile residue is subjected to steam stripping at a substantially higher temporature than employed in the initial step. Superheated steam at about 1200° F. will cause additional hydrocarbons to be volatilized from the residue which is heated to about 1000°–1050° F. by the steam. This volatile fraction is combined with the volatile fraction from the initial step and both are fractionally distilled to provide gaseous hydrocarbons, naphtha, gas oil and a low metals bottoms fraction. The residue from the steam stripping is utilized as a fuel to provide heat for the process. The residue combustor may be employed in a variety of ways depending on the heat available therein and the heat requirements of the overall process. Thus, water may be turned into superheated steam to serve as stripping steam in the process. Additionally, the coal may be preheated by indirect heat exchange in the combustor. If sufficient heat is available, the residual oil may likewise be preheated here. Alternatively, a slurry of coal and residual oil may be preheated to the process temperature of the initial step in the process.

In summary, the system of this invention generates metal-free distillates by co-processing coal and residual oil whereby the metals contained in the resid are deposited on the solid portion of the coal which remains after the volatilized/solubilized portion of the coal is generated and removed. This process produces a solid fuel which is used to furnish steam and the necessary energy for the process as well as excess steam for general use and power generation.

The present invention permits the integration of coal into a conventional petroleum refinery. Further, the process permits coal to be processed with heavy residual oil at a time when the use of heavier crude oils and the concomitant increase in the availability of residual non-distillate oils makes it economically attractive to identify process configurations that combine the use of coal with heavy resid.

In practicing this invention mixtures of coal and petroleum residual oil are employed. As used herein, the term "coal" is used to designate a normally solid carbonaceous material including all types of coal, such as bituminous coal, semibituminous coal, subbituminous coal, lignite, peat and mixtures thereof.

The petroleum residual oil (also referred to as resid or residua herein) employed in the process of this invention includes heavy mineral oils, whole or topped crude oils, atmospheric tower residua, i.e., boiling above about 700° F. and vacuum tower residua, i.e. boiling above about 1000° F., deasphalted tars and bottoms fractions from catalytic cracking units and other refinery operations. Asphalts, raw creosote oils, high-boiling crude oils, tars, bitumens, tar sand oils, shale oils and the like may also be employed. Such oils will normally contain constituents boiling above 700° F. and will have API gravities in the range of about −5° to about +20° API and Conradson carbon values of about 1% or more. High boiling residual petroleum residues, i.e. 1000° F.+residual oils, are the preferred feedstocks for use in the process of this invention.

Residual oils often contain high levels of metals which can poison petroleum processing catalysts. Metals such as nickel and vanadium are particularly troublesome catalyst poisons. Since the process of the present invention is particularly directed to reducing the metals content of residual oils, it is especially useful in providing low metals content distillates from high metals content residua. Therefore, residual oils having metal contents of about 60 to about 6000 ppm (expressed as nickel plus vanadium) may be usefully employed in the present process.

A preferred embodiment of this invention will be described with reference to FIG. 1 of the drawing. A residual oil, such as a 1050° F.+vacuum pipestill bottoms, is introduced through line 2 into heater 4 which increases the temperature of the resid to about 930° F. which is about the incipient coking temperature of the resid. The heated residua is then introduced into the bottom of riser conversion zone 6. Hot coal at a temperature of about 700° F. passing through coal conduit 8, provided with flow control valve 10, enters the bottom of riser conversion zone 6 for admixture with the residual oil. The oil and coal are provided in a weight ratio to achieve a temperature of about 860° F. for the admixture. The mixture of coal and resid pass upward through riser conversion zone 6 under conversion conditions which are effective to cause a portion of the coal to be volatilized and solubilized by the oil. Simultaneously some of the oil is volatilized and the metals from the resid are deposited on the solid coal residue. However, the temperature and space velocity conditions are such that substantially no coking of the residual oil occurs. The resulting admixture passes upward through the riser and discharges from the upper end of riser conversion zone 6 through horizontally radiating arms 12 which are provided with a curved inner surface and confining sidewalls and which terminate in a downward direction so as to promote a separation of the volatile portion of the admixture from the non-volatile portion. The admixture passes from the radiating arms into the upper portion of vessel 14 in a downward direction which causes the non-volatile residue to pass into the open upper end of stripping chambers 16 positioned beneath each of the downward pointing ends of radiating arms 12. Stripping chamber 16 is provided with a series of downwardly sloping baffle members to provide a tortuous path for downflowing residue countercurrent to upflowing stripping gas. Each stripping chamber is provided with a source of superheated stream which enters the lower portion of the stripping chamber and passes upward through the downwardly cascading non-volatile residue. The superheated steam is introduced through line 18 at a temperature of about 1200° F. which causes the non-volatile residue to be heated to about 1000°–1050° F. causing additional material to be volatilized. This second volatilized hydrocarbon fraction is carried out of the upper end of stripping chamber 16 by the stripping steam. At this point the second volatilized hydrocarbon fraction becomes mixed with the first volatilized hydrocarbon fraction which is discharging from horizontally radial arms 12 and is carried to the upper portion of vessel 14 where the combined volatile fractions pass through cyclone 20 where any solid particles contained therein are removed and pass to the lower portion of vessel 14 through dipleg 22. The combined volatile fractions pass from the cyclone through line 24 and are transferred from vessel 14 by means of line 26 to a conventional fractionating unit 28 where the combined volatile fractions are separated into metal-free product steams such as gas, naphtha, light and heavy gas oil and bottoms. Other distillate fractions can be obtained by the use of additional side stream drawoffs and/or the use of vacuum distillation equipment as is well known in the art.

Returning to the non-volatile residue, it passes from the bottom of stripping chamber 16 after having been stripped with superheated steam and collects in the bottom of vessel 14 together with any solids recovered through dipleg 22. The stripped non-volatile residue comprises 1050° F.+resid, metals from the resid and coal residue. This residue passes from vessel 14 through residue conduit 30 into combustor 32. The residue is directed to the lower portion of the combustor vessel which is separated from the upper portion by combustor riser 34. The combustor riser is a separation means separating upper and lower chambers in the combustor vessel, a support for feed coal and a passage for combustion gasses for indirectly heating the feed coal. The combustor riser permits gas to flow from the lower to the upper portion of combustor 32 and is designed to confine a body of coal above a body of the non volatile residue located in the lower portion of the combustor. The non-volatile residue is supported in the combustor on grate 36 positioned above air inlet ports 38. Air is supplied through line 40 to the air inlet ports 38. As the air passes through the body of non-volatile residue it causes the carbon-containing portion of the residue to burn, producing high temperature flue gas which passes up through the body of residue, through combustor riser 34 and into the upper portion of combustor 32.

Fresh coal is introduced through line 42 into combustor 32 at a point above where combustor riser 34 is connected to the vertical wall of the combustor. A body of coal collects in the portion of combustor 32 described by the upper sidewalls of the combustor and the upper surface of combustor riser 34 where it is heated to about 700° F. by indirect heat exchange with the high temperature flue gas passing from the burning non-volatile residue up through the combustor riser. As the coal achieves the desired temperature, flow control valve 10 is opened to permit the coal to flow through coal conduit 8 to riser conversion zone 6.

The high temperature flue gas passes through the upper portion of combustor riser 34 and flows past steam coil 44 which is supplied with water by means of line 46. The flue gas produces superheated steam at about 1200° F. in steam coil 44 when it passes in indirect heat exchanger relationship thereto. The superheated steam leaves combustor 32 through line 18 which supplies the steam to stripping chamber 16 located in vessel 14. Any steam not required for stripping may be utilized for general use or power generation on the refinery site by additional supply lines (not shown).

After flowing past the steam coil, the flue gas enters cyclone 48 which removes any entrained solids from the flue gas before it is removed from combustor 32 through conduit 50 and line 52. The solids removed by cyclone 48 are returned to the lower portion of combustor 32 through dipleg 54.

As the non-volatile residue is burned in combustor 32, it is reduced to an ash containing the metals originally present in the residual oil feed. The ash passes through grate 36 where it collects in the bottom of combustor 32. The ash may be removed continuously or periodically through line 56 for disposal. Where economically attractive, the metals in the ash may be removed therefrom by any of several metals recovery processes known in the art.

Although it is preferred to separately preheat the coal and the residual oil in a fashion such as that discussed hereinbefore or by similar means known to those skilled in the art, other means of providing the necessary preheat may be employed when practicing the process of the present invention. For example, the coal and residual oil can be mixed together and the admixture passed through the combustor or other suitable heat source in indirect heat exchange relationship thereto to provide the admixture of coal and residual oil at the temperature required to achieve the desired result in the conversion zone employed in the subject process.

In practicing the invention, process conditions are employed which are effective to produce the desired result in each operation. Thus, in the initial conversion zone the operating conditions must be effective to volatilize and solubilize the coal and demetallize the residual oil while substantially preventing the formation of coke from the residual oil. Effective operating conditions for this conversion zone include a temperature of 800°-900° F., preferably 850°-875° F., a weight ratio of coal to oil of about 0.1 to about 1.0, preferably about 0.2 to about 0.3 and a residence time of about 0.5 to about 10 seconds, preferably about 0.5 to about 4 seconds.

The steam stripping is also conducted under conditions which will substantially prevent coking of any residual oil remaining after passage through the conversion and which will cause additional volatile hydrocarbons to be formed. Superheated steam at a temperature of about 1150° to about 1250° F. will be effective. The strippers should be designed to provide intimate contact between the steam and the non-volatile residue as they pass in countercurrent relationship. Assuming effective contact is obtained, residence times of about 10 to about 45 seconds, preferably about 15 to about 30 seconds in the stripper should prove adequate. Temperatures in the steam stripping zone will generally be about 1000°-1100° F., preferably 1025°-1075° F.

The operating parameters employed when fractionating the combined volatile fractions are those conventionally employed in petroleum distillation units, are therefore well known to those skilled in the art and need not be enumerated here.

The operation of the combustor is not critical. Therefore, the quantity of air will be dependent on the quantity and quality of the residue to be burned as well as the process requirements for superheated steam and coal preheat and the particular design employed for the combustor and its attendant equipment. Those skilled in the art are familiar with the effective operation of such a processing unit.

Figure 2:
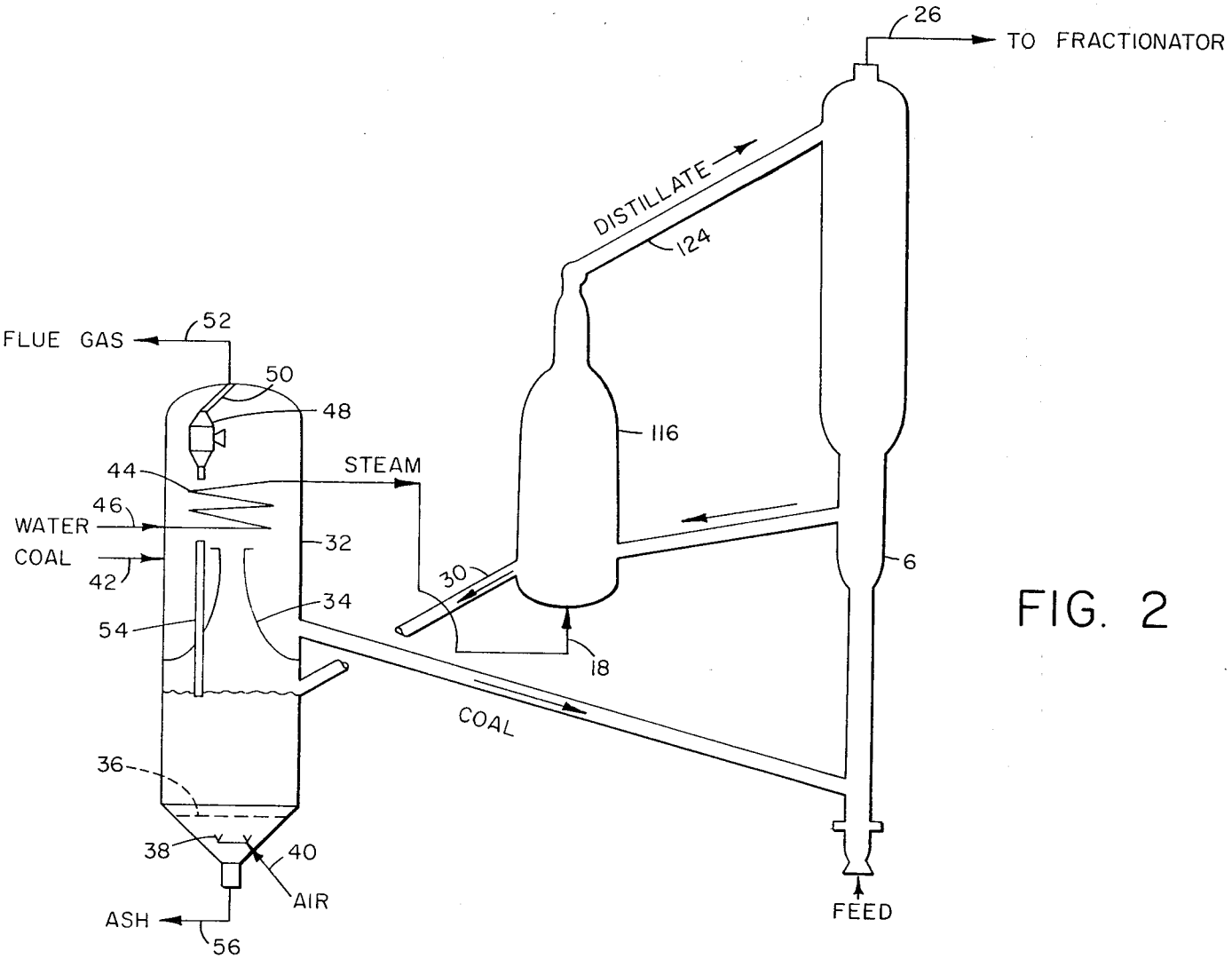

Referring to FIG. 2, an alternative system is shown wherein the thermal cracking zone reactor 6 is housed separately from the enclosed steam stripping zone portion 116. Unless otherwise noted, the number elements in FIG. 2 correspond to the same system components in FIG. 1. Heated particulate coal is transported from vessel 32 by gravity, screw conveyor or the like and mixed with preheated residual oil feed at the bottom inlet to the vertical cracking reactor 6. As the hot mixture rises through this reactor, volatile components are generated and withdrawn from the reactor top outlet 25. Non-volatile residue is then transported by gravity or mechanical conveyor means to stripping vessel 116, where it is contacted with higher temperature steam introduced through bottom inlet 18. Distillate from the stripping zone may be separately recovered or passed to the fractionator in mixture with volatile matter from reactor 6. The stripped solids are then withdrawn through conduit 30 and passed to the combustion zone.

While the invention concept has been shown by specific examples, there is no intent to limit the inventive concept except as set forth in the following claims:

What is claimed is:

1. Apparatus for converting coal and oil to volatile hydrocarbons comprising:

(a) a combustor having an upper heating chamber and a lower combustion chamber;

(b) a combustor riser means for separating said upper heating chamber and said lower combustion chamber and for supporting feed coal thereon, said combustor riser mean comprising means for the passage of combustion gases therethrough, thereby indirectly heating the feed coal supported thereon;

(c) inlet means for a stripped non-volatile hydrocarbon portion and means for combusting the stripped non-volatile hydrocarbon portion in said combustion chamber to produce hot combustion gas;

(d) means for introducing air to said combustion chamber;

(e) means for passing water through said heating chamber wherein hot combustion gases from said combustion chamber indirectly heat the water to generate steam;

(f) means for introducing feed coal into said heating chamber on top of said combustor riser means, the feed coal being indirectly heated by hot combustion gas passing through said passage means of said combustor riser; and (g) means for removing effluent gas from said heating chamber.

2. The apparatus according to claim 1, wherein the combustor riser means is essentially vertical and said passage mean comprising having a central opening.

3. Apparatus for converting coal and oil to volatile hydrocarbons comprising:

(a) a riser reactor having an upper portion and a lower portion;

(b) a first inlet means in the lower portion of said reactor for introducing preheated feed coal to said reactor;

(c) a second inlet means in the lower portion of said reactor for introducing oil to said reactor for admixture with said preheated feed coal;

(d) an outlet means in the upper portion of said reactor for delivering a first cracked hydrocarbon volatilized portion and a non-volatilized hydrocarbon portion from said reactor;

(e) a steam stripping vessel having an upper portion and a lower portion, said outlet means of said reactor communicating with the upper portion of said stripping vessel wherein said first cracked hydrocarbon volatilized portion is separated from said non-volatilized hydrocarbon portion;

(f) a stripping chamber within said lower portion of said stripping vessel, said stripping chamber receiving said non-volatilized hydrocarbon portion from said upper portion of said stripping vessel;

(g) means for introducing steam to said stripping chamber, said steam contacting said non-volatilized hydrocarbon portion producing a second cracked volatilized hydrocarbon portion;

(h) means for fractionating said first and second volatilized hydrocarbon portions to obtain hydrocarbon products;

(i) means for transporting said first and second volatilized hydrocarbon portions from the upper portion of said stripping vessel to said fractionating means;

(j) a combustor having an upper heating chamber and a lower combustion chamber;

(k) a combustor riser means for separating said upper heating chamber and said lower combustion chamber and for supporting feed coal thereon, said combustor riser means comprising means for the passage of combustion gases therethrough, thereby indirectly heating the feed coal supported thereon;

(l) means for transporting the stripped non-volatile hydrocarbon portion from said stripping chamber to said combustion chamber to produce hot combustion gas;

(m) means for introducing air to said combustion chamber;

(n) means for passing water through said heating chamber wherein hot combustion gases from said combustion chamber indirectly heat the water to generate steam;

(o) means for transporting said steam generated in said heating chamber to said means for introducing steam to said stripping chamber;

(p) means for introducing feed coal into said heating chamber on top of said combustor riser means, the feed coal being indirectly heated by hot combustion gas passing through said passage means of said combustor riser;

(q) means for transporting heated feed coal from said heating chamber to said first inlet means; and (r) means for removing effluent gas from said heating chamber.

4. The apparatus according to claim 3, wherein the combustor riser means is essentially verticle and said passage means comprising a central opening.

5. The apparatus according to claim 3 wherein said riser reactor is an interior tubular riser within a vertical vessel containing the steam stripping chamber outside said riser reactor.

6. The apparatus according to claim 5 wherein the stripping chamber is disposed in said vertical vessel and is located in an annular portion of the vertical vessel surrounding the interior tubular riser, said annular portion of said vertical vessel supporting a downwardly staggered array of stripping baffles and said means for introducing steam comprising steam inlet means at the bottom of the stripping chamber for countercurrent stripping.

7. The apparatus according to claim 5 wherein said outlet means for said reactor includes a plurality of horizontally radial conduits for distributing reaction products from the riser reactor outwardly, said radial conduits terminating above the outer steam stripping chamber whereby non-volatile portions of said reaction product flow downward by gravity through the stripping chamber and the first volatilized portion is separated from the non-volatile portion above the stripping chamber.

8. The apparatus according to claim 7 further comprising means for combining the first volatilized portion with the second volatilized portion prior to fractionation.

9. The apparatus according to claim 7, wherein said radial conduits are provided with a curved inner surface and confining sidewalls which terminate in the downward direction.

* * * * *

UNITED STATES PATENT AND TRADEMARK OFFICE

CERTIFICATE OF CORRECTION

PATENT NO. : 4,552,725

DATED : November 12, 1985

INVENTOR(S) : Costandi A. Audeh

It is certified that error appears in the above-identified patent and that said Letters Patent is hereby corrected as shown below:

Column 4, line 3, "Residue" should be --residual--

Column 8, line 1, "invention" should be --inventive--

Column 8, line 12, "mean" should be --means--

Column 8, line 35, "mean" should be --means--

Signed and Sealed this

Thirtieth Day of December, 1986

*Attest:*

DONALD J. QUIGG

*Attesting Officer*

*Commissioner of Patents and Trademarks*